US005131254A

United States Patent [19]

White

[11] Patent Number: 5,131,254

[45] Date of Patent: Jul. 21, 1992

[54] APPARATUS FOR BENDING BEAMS

[75] Inventor: Francis E. White, Birmingham, Ala.

[73] Assignee: Whitefab, Inc, Ensley, Ala.

[21] Appl. No.: 647,057

[22] Filed: Jan. 29, 1991

[51] Int. Cl.[5] ..... B21D 7/025

[52] U.S. Cl. ..... 72/387; 72/413; 72/466

[58] Field of Search ..... 72/387, 388, 466, 369, 72/370, 413

[56] References Cited

U.S. PATENT DOCUMENTS

| | | | |
|---|---|---|---|
| 1,456,598 | 3/1923 | Jackson . | |
| 2,266,912 | 12/1941 | Shaw, Jr. | 72/481 |
| 2,347,593 | 4/1944 | Cummings . | |
| 2,371,393 | 3/1945 | Horrigan . | |
| 2,729,265 | 1/1956 | Jones | 72/466 |
| 3,396,565 | 8/1968 | Miller . | |
| 3,426,569 | 2/1969 | Brauer et al. | 72/413 |
| 3,504,520 | 4/1970 | Matson | 72/466 |
| 4,133,198 | 1/1979 | Huda et al. . | |
| 4,142,394 | 3/1979 | Damman . | |
| 4,608,849 | 9/1986 | Brugman | 72/466 |
| 4,712,406 | 12/1987 | Molz | 72/413 |

FOREIGN PATENT DOCUMENTS

| | | | |
|---|---|---|---|
| 0398280 | 11/1990 | European Pat. Off. | 72/413 |
| 0235521 | 9/1990 | Japan | 72/466 |

*Primary Examiner*—David Jones

*Attorney, Agent, or Firm*—Jennings, Carter Thompson & Veal

[57] ABSTRACT

Apparatus for bending elongated members transversely to a web thereof without substantially altering the cross-sectional configuration thereof including a flexible form having a plurality of pivotal seats and flexible plates. Flexible mandrels including a plurality of parallel plates are received within the elongated members and, in combination with a plurality of clamps, the flexible form and a press plate supporting the elongated member, prevent the bending forces exerted thereon from distorting the cross-sectional configuration of the elongated members. The flexible form distributes the exerted force required to bend the elongated member over a selected length thereof, thereby reducing the unit force exerted on any selected point to a level that will not buckle the elongated member.

31 Claims, 10 Drawing Sheets

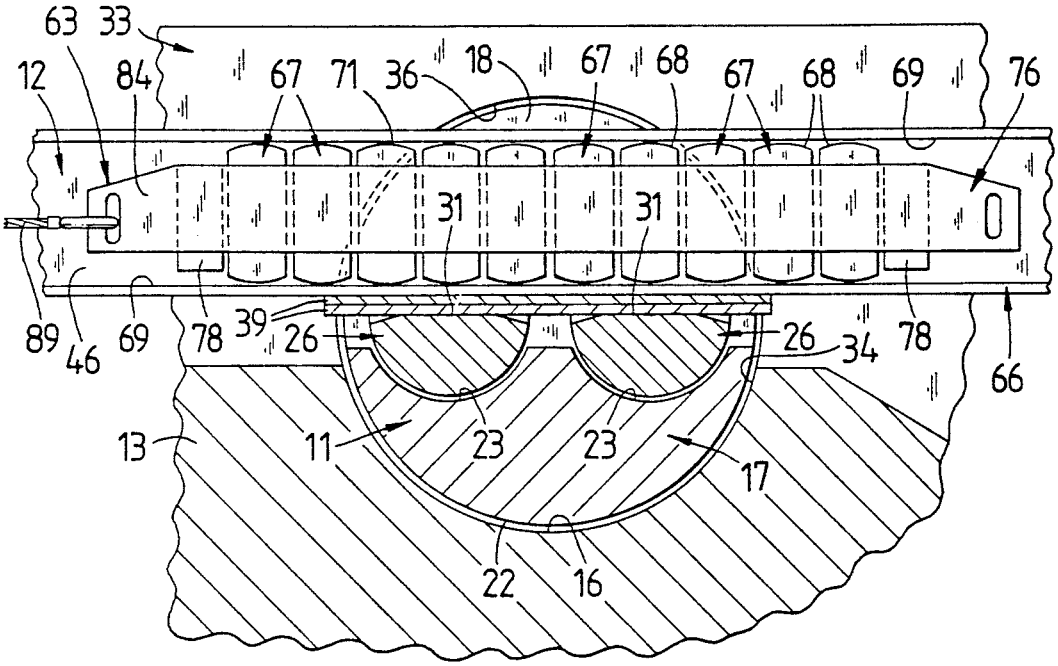
FIG. 2
FIG. 3
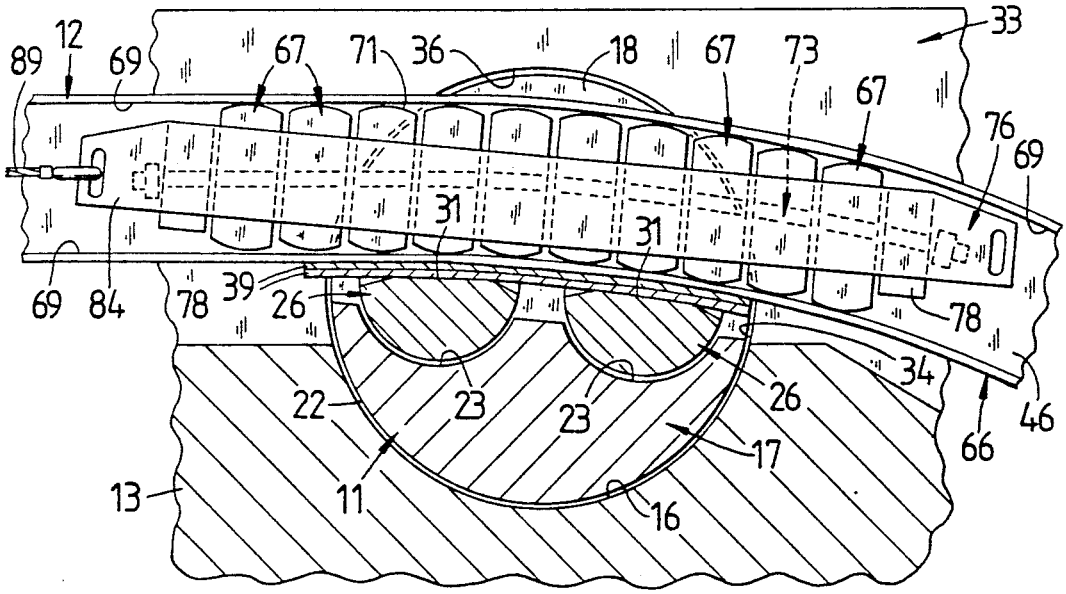

APPARATUS FOR BENDING BEAMS

FIELD OF THE INVENTION

The present invention relates to an apparatus for bending steel or other metals. More particularly, the present invention relates to an apparatus for bending beam members having flanges, webs or walls. In greater particularity, the present invention relates to an apparatus for bending a variety of elongated members such as channel members, I-beams and rectangular tubing without altering the cross-sectional configuration thereof.

BACKGROUND OF THE INVENTION

Apparatus for bending elongated beam members are commonly found in the steel fabrication industry and can be generally categorized into two groups, those using a rotating wheel as a fulcrum and those using a fixed nonflexible arcuate surface as a fulcrum. U.S. Pat. No. 4,142,394 issued to Damman on Mar. 6, 1979 is exemplary of both groups. In FIGS. 1-3, Damman discloses a template having a longitudinally curved template face about which a strip length is bent by the upward movement of a press device. FIG. 5 of Damman shows a forming roll being used as a rotating fulcrum about which a strip length is bent.

U.S. Pat. No. 4,133,198 issued to Huda et al on Jan. 9, 1979 discloses an apparatus for bending boiler tubing about the arcuate surface of a cylindrically shaped part.

U.S. Pat. No. 3,396,565 issued to Miller on Aug. 13, 1968 discloses an arcuate shoe which is urged against a secured elongated tubular member to bend the member about the curvature of the shoe.

U.S. Pat. No. 2,371,393 issued to Horrigan on Mar. 13, 1945, discloses a matrix having a curved bending face against which a pipe is pressed and bent. The matrix has a plurality of openings which, in combination with a punch received within the pipe, corrugates the pipe to facilitate easier bending.

U.S. Pat. No. 2,347,593 issued to Cummings on Apr. 25, 1944 shows a pipe bending apparatus having a template with a curved bearing face. A pipe to be bent is fitted with a plurality of arcuate shoes which prevent the pipe from being cross-sectionally disfigured during bending. The shoes have a plurality of heels which contact the curved bearing face as the pipe is urged thereto and distribute the bending force across the shoe and consequently along the cross-section of the pipe.

U.S. Pat. No. 1,456,598 issued to Jackson on May 29, 1923 discloses a bending apparatus having an arcuate form against which a tubular pipe is urged and bent.

The common denominator of the aforementioned patents is that the devices disclosed are used to bend cylindrical tubular members or strips having solid rectangular cross-sections. Furthermore, the bending force exerted against the elongated member is concentrated, if only for a short period, at a singular point along the length of the elongated member. When such apparatus are used to bend elongated members having webs, flanges or rectangular tubular cross-sections, the force required to bend such beam members is usually greater than the force such webs, flanges or rectangular tubes can withstand at a singular point without being distorted. Consequently, what is needed is an apparatus for bending elongated beam members such as I-beams, channel members and rectangular tubing without distorting the same.

SUMMARY OF THE INVENTION

The principal object of the invention is to provide apparatus for bending elongated beam members having webs, flanges or rectangular tubular cross-sections.

A particular object of the invention is to facilitate bending of an I-beam or channel member "the hard way" such that the member is bent in the plane of the web.

In support of the principal object, another object of the present invention is to provide apparatus for bending I-beams, channel members and rectangular tubing without altering the cross-sectional configuration thereof.

In support of the aforementioned objects, another object of the present invention is to provide apparatus which simultaneously distributes bending forces across a predetermined length of the elongated member to be bent.

These and other objects and advantages of the present invention are accomplished through the use of a form supported on a base and including a primary seat movably connected to the base and a pair of rotatable secondary seats carried by the primary seat. The secondary seats have substantially planar outer faces abutting one or more flexible plates.

The form is supported by a base included in a frame having a press plate which extends proximal the base and along which an elongated member is intermittently conveyed. The frame supports a brace roller which restricts the lateral movement of a first end portion of the elongated member in a first direction while a bending ram, also connected to the frame, urges a second end portion of the elongated member against the form for bending thereabout. Clamps connected to the frame and the bending ram hold the elongated member in sliding contact with the press plate throughout the bending process.

To prevent distortion of the section of the elongated members when making severe bends, or bends to a short radius, a flexible mandrel may be used inside the elongated member. When bending elongated members to a larger radius, no mandrels are needed. Flexible mandrels are received within the elongated members and are secured proximal the portion thereof being bent. The mandrels include a plurality of parallel plates having a flexible rod extending normally therethrough. The plates have rounded lateral faces located in non-contacting proximity to the interior webs, walls or flanges of the elongated member.

BRIEF DESCRIPTION OF THE DRAWINGS

Apparatus embodying features of my invention are depicted in the accompanying drawings which form a portion of this disclosure and wherein:

FIG. 2 is a plan view of a seat with an unbent beam member supported proximal thereto with a mandrel in place;

FIG. 3 is a plan view of a seat with a beam member bent thereabout with a mandrel in place;

FIG. 6 is a sectional view taken along line 6—6 of FIG. 1;

DESCRIPTION OF A PREFERRED EMBODIMENT

Figure 1:
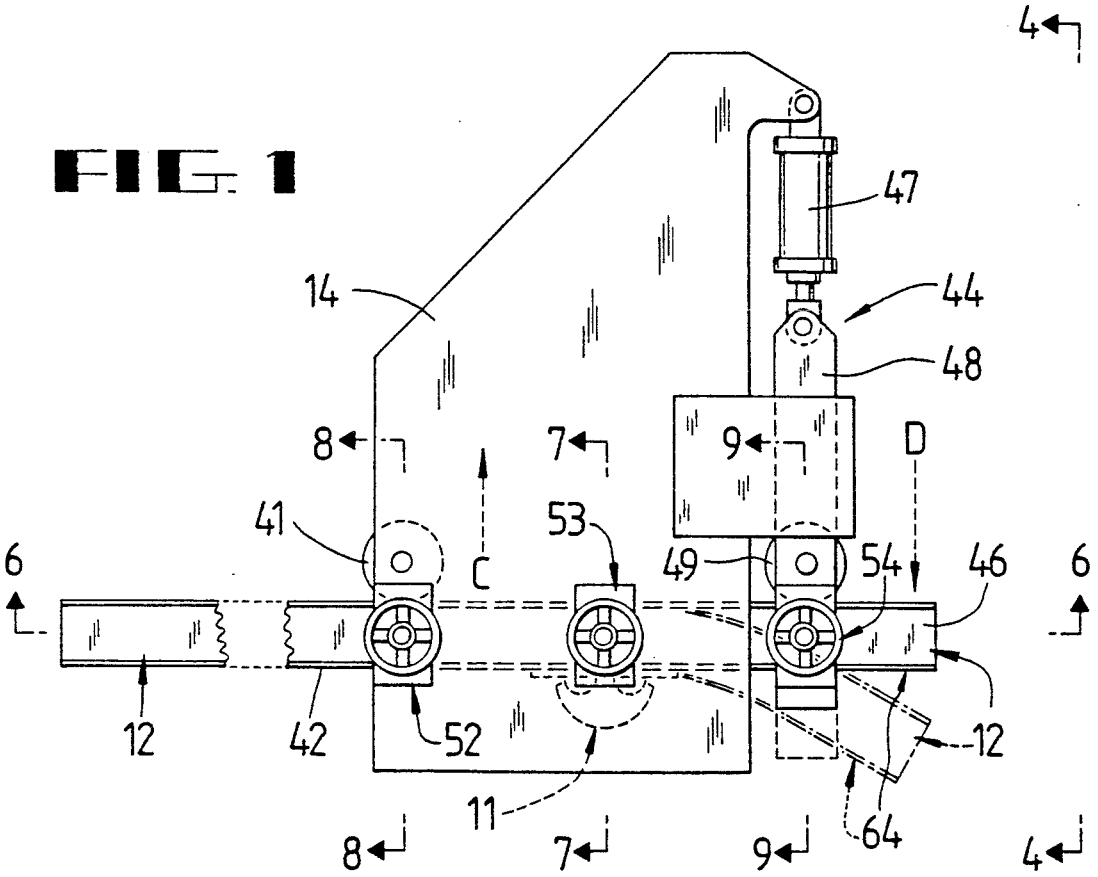
FIG. 1 is a plan view of the present invention.
Figure 4:
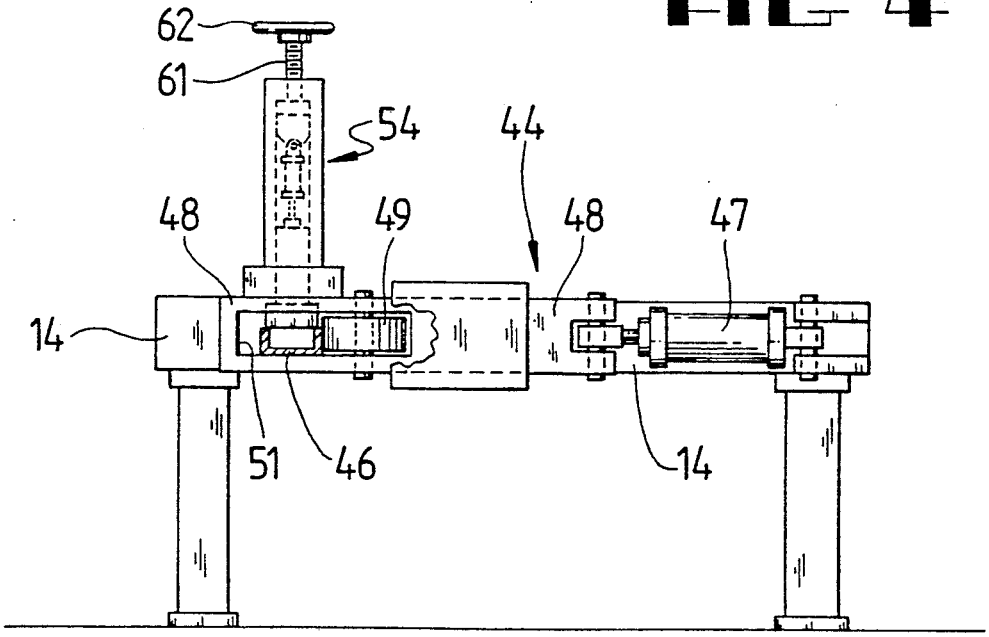
FIG. 4 is a side elevational view of the present invention taken along line 4—4 of FIG. 1.
Figure 5:
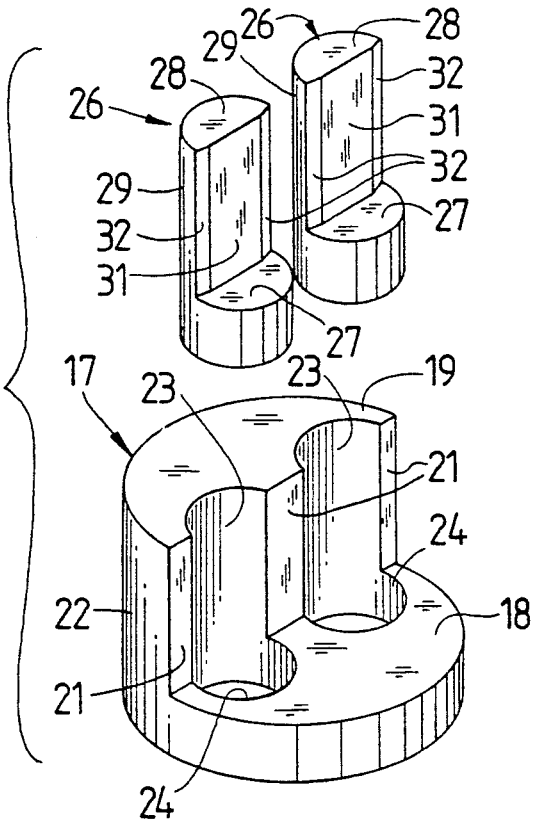
FIG. 5 is an exploded perspective view of the primary and secondary seats.
Figure 13:
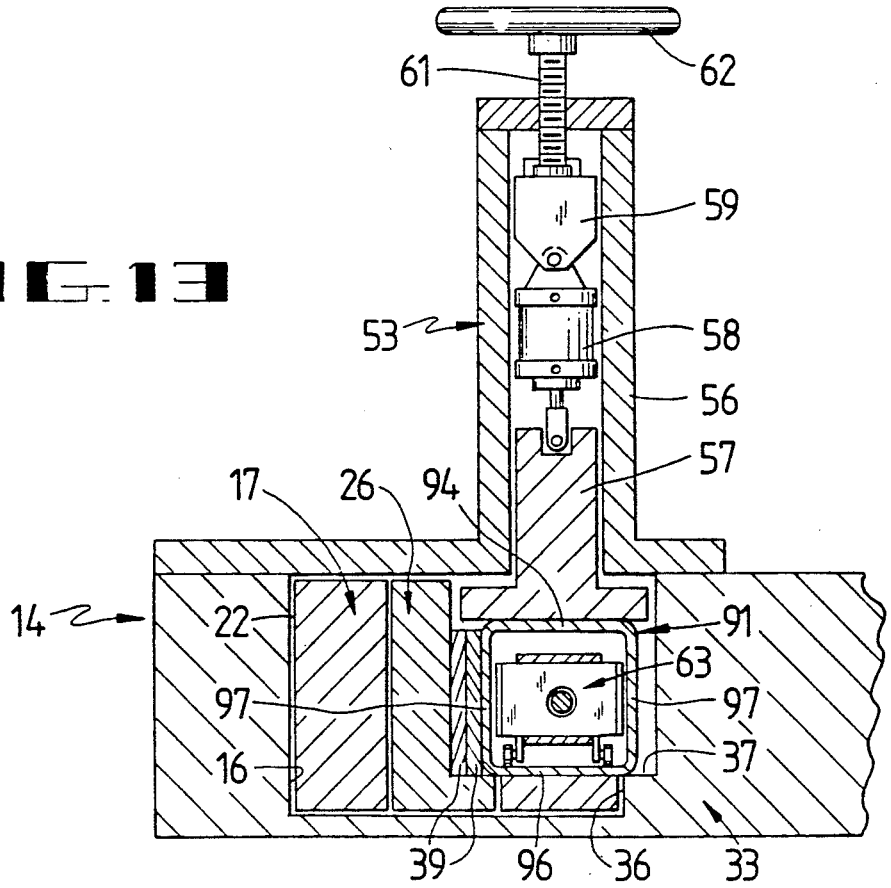
FIG. 13 is a sectional view of a second embodiment of a mandrel seated within a rectangular tube member and supported by the present invention.
Figure 5:
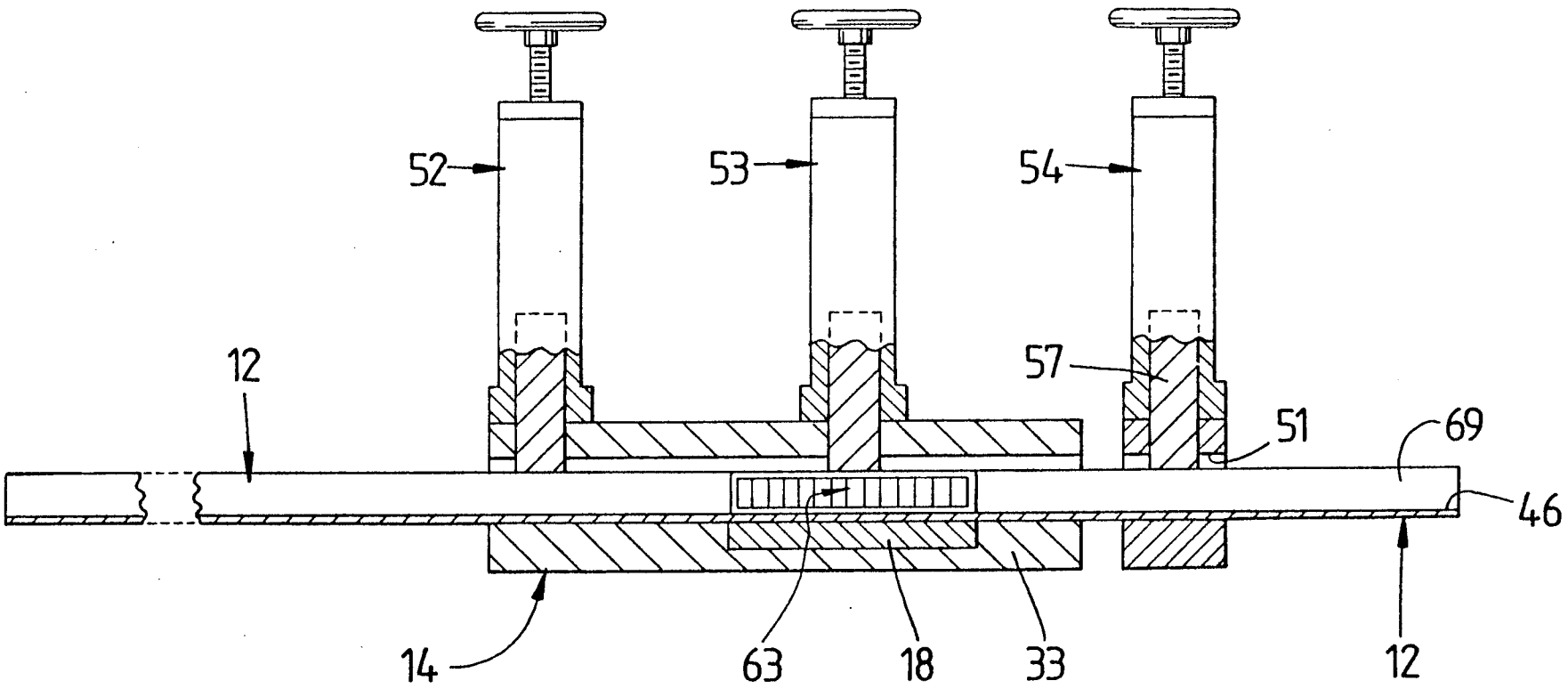

Referring to the drawings for a clearer understanding of the invention, it should be noted in FIGS. 1-3 that the present invention contemplates the use of a form 11 about which an elongated member 12 is bent to a selected curvature. As shown in FIGS. 2-4, the form 11 is supported in a base 13 which is connected to and supported by a frame 14. As shown in FIGS. 2 and 3, the base 13 has a semi-cylindrical recess 16 in which a primary seat 17 is received for rotational movement about a vertical axis. As shown in FIG. 5, the primary seat 17 has a cylindrical first table 18 and a semi-circular first upright portion 19 integrally connected to the first table to define face 21 and a first arcuate surface 22 which fits within the recess 16 in sliding rotational abutment therewith. The primary seat 17 has a pair of parallel semi-cylindrical outwardly opening recesses 23 which extend vertically along the face 21 to join a pair of holes 24 extending through table 18. A plurality of secondary seats 26 are received within the recesses 23 and holes 24 for rotational movement about spaced vertical axis. Each secondary seat 26 includes a cylindrical second table 27 and a semi-cylindrical second upright portion 28 integrally connected to the second table 27 to define a second arcuate surface 29.

Each secondary seat 26 is received within a secondary recess 23 with each second table 27 being received within an associated hole 24, wherein the second arcuate surface 29 fits within the primary seat 17 for sliding rotational movement about a vertical axis. The second upright portion 28 extends outwardly from the secondary recess 23 and is partially defined by an outer face 31 which, though substantially planar, has beveled vertical edges 32.

FIGS. 2, 3, 6 and 7 show a press plate 33 integrally connected to the frame 14. The press plate 33 extends on either side of the first table 18 and has a semi-circular recess 34 which in combination with the recess 16 defines a circular receptacle 36 in which the first table 18 is retained for rotational movement about a vertical axis. The press plate 33 defines a horizontal surface 37 which extends in coplanar relation with an upper surface 38 defined by the first and second tables 18 and 27.

The elongated member 12 is supported on the press plate 33 proximal the form 11. One or more parallel flexible plates 39 are supported on the first and second tables 18 and 27 intermediate the elongated member 12 and the outer faces 31 in substantially parallel planar relation thereto. The resistance provided by the form 11 to bending pressure exerted on the member 12 is uniformly distributed across the flexible plates 39; and thus, across a similar length of the elongated member 12 contacted thereby. Such uniform distribution is facilitated by the rotational movement of the primary seat 17 within the base 13, the rotational movement of the secondary seats 26 within the primary seat 17 and the flexibility of the plates 39. Such flexibility in combination with the articulated seats 17 and 26 permit the required resistance to be exerted against the elongated member 12, but never at a singular point along the length thereof.

Figure 8:
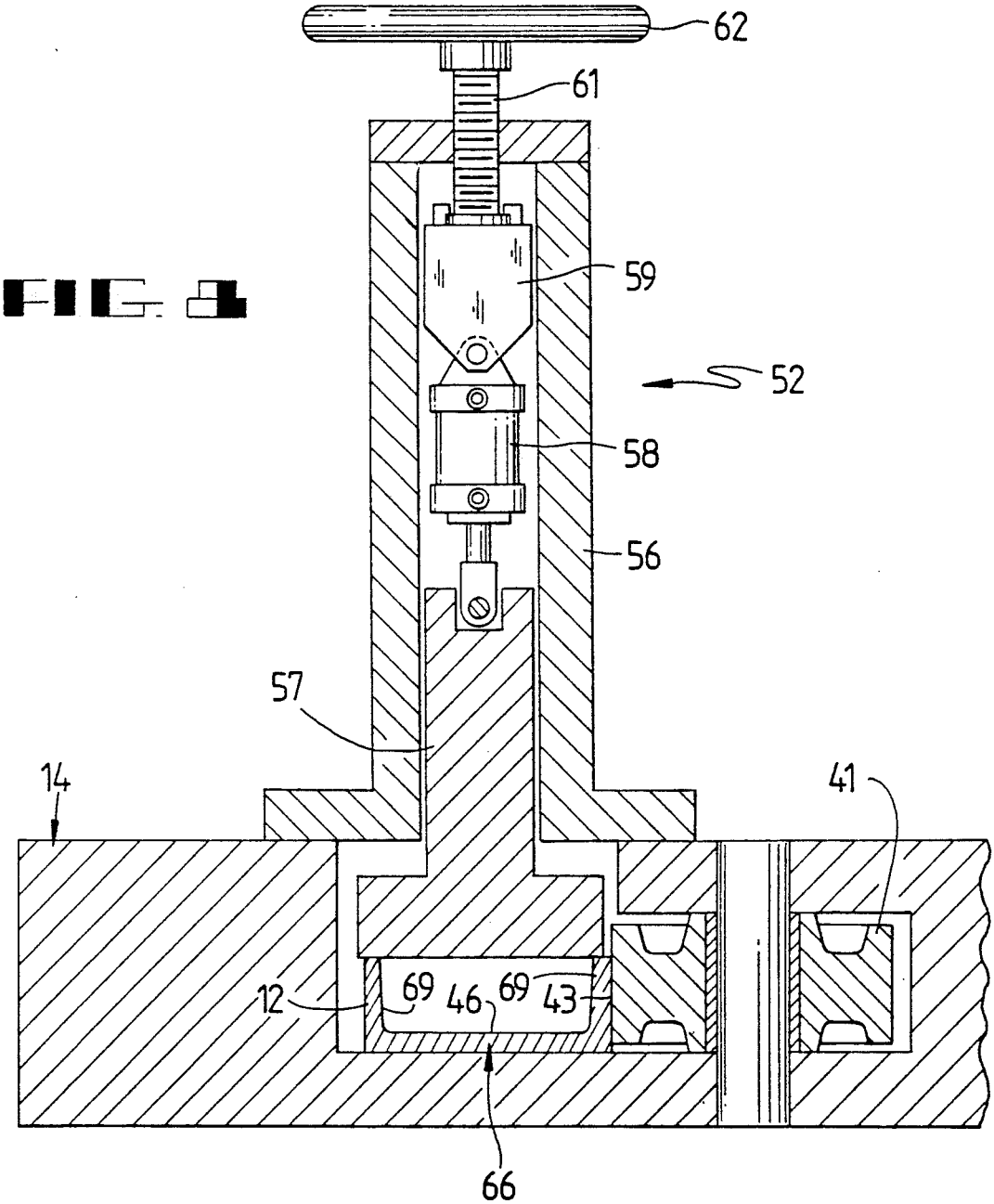
FIG. 8 is a sectional view taken along line 8—8 of FIG. 1.

FIGS. 1 and 8 show a brace roller 41 rotatably mounted to the frame 14 for restricting the lateral movement of a first end portion 42 of the elongated member 12. The brace roller 41 provides a surface 43 against which the first end portion 42 of the elongated member 12 can be braced while the elongated member is bent about the form 11.

A bending ram 44 for urging the elongated member 12 is shown in FIGS. 1 and 4 and is slidably connected to the frame 14 for reciprocal movement in the plane of a web 46 of the elongated member to be bent. The bending ram 44 includes a hydraulic actuator 47 pivotally connected to the frame 14 and to a ram slide 48 for forcing the slide 48 against the elongated member. As is further shown in FIG. 9, a contact wheel 49 is mounted to the slide 48 for rotational movement about a vertical axis and contacts the elongated member 12 to urge the same about the form 11. The slide 48 forms a transverse channel 51 within which the contact wheel 49 is mounted and through which the elongated member 12 extends in engagement with the contact wheel 49.

Figure 7:
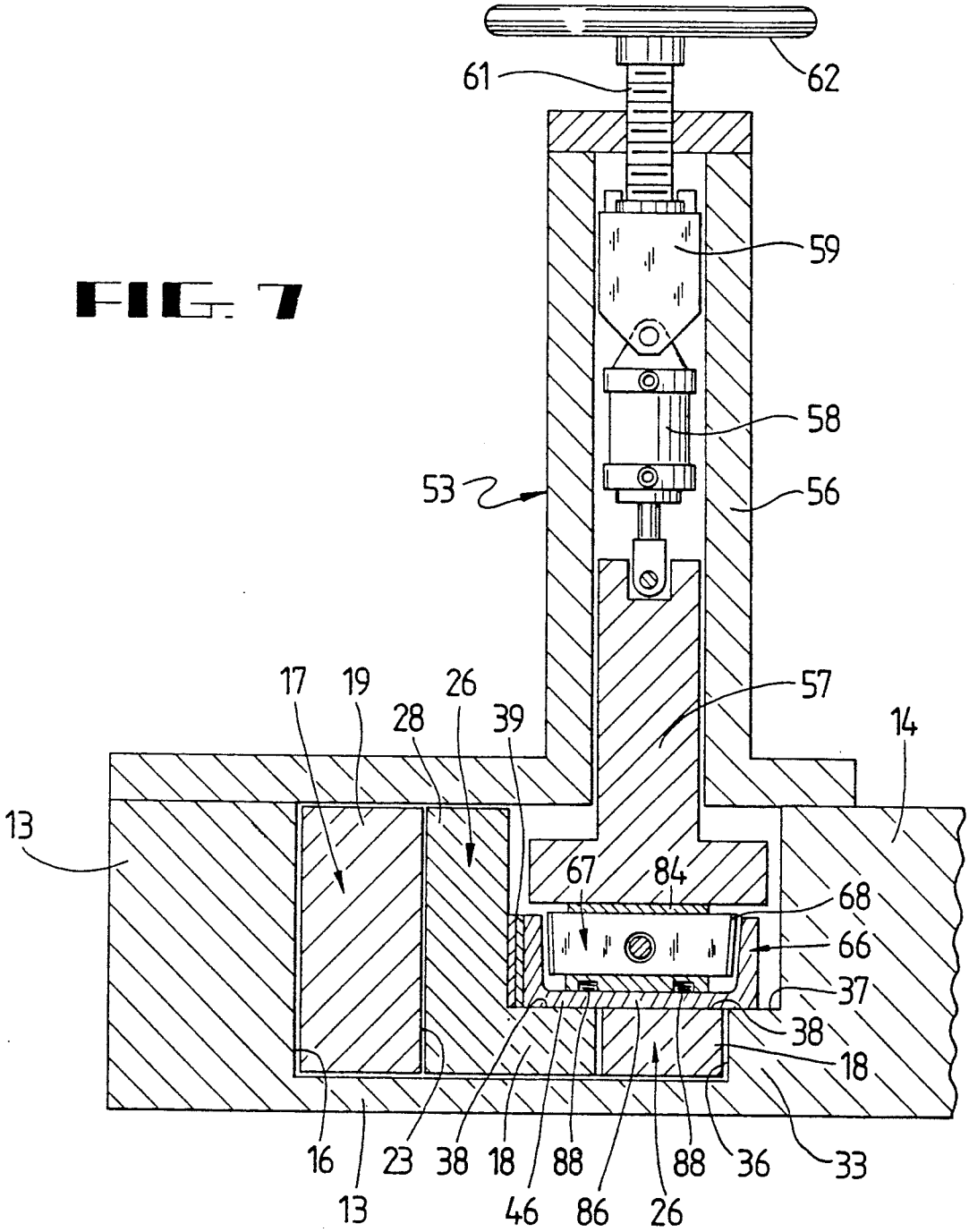
FIG. 7 is a sectional view taken along line 7—7 of FIG. 1.
Figure 9:
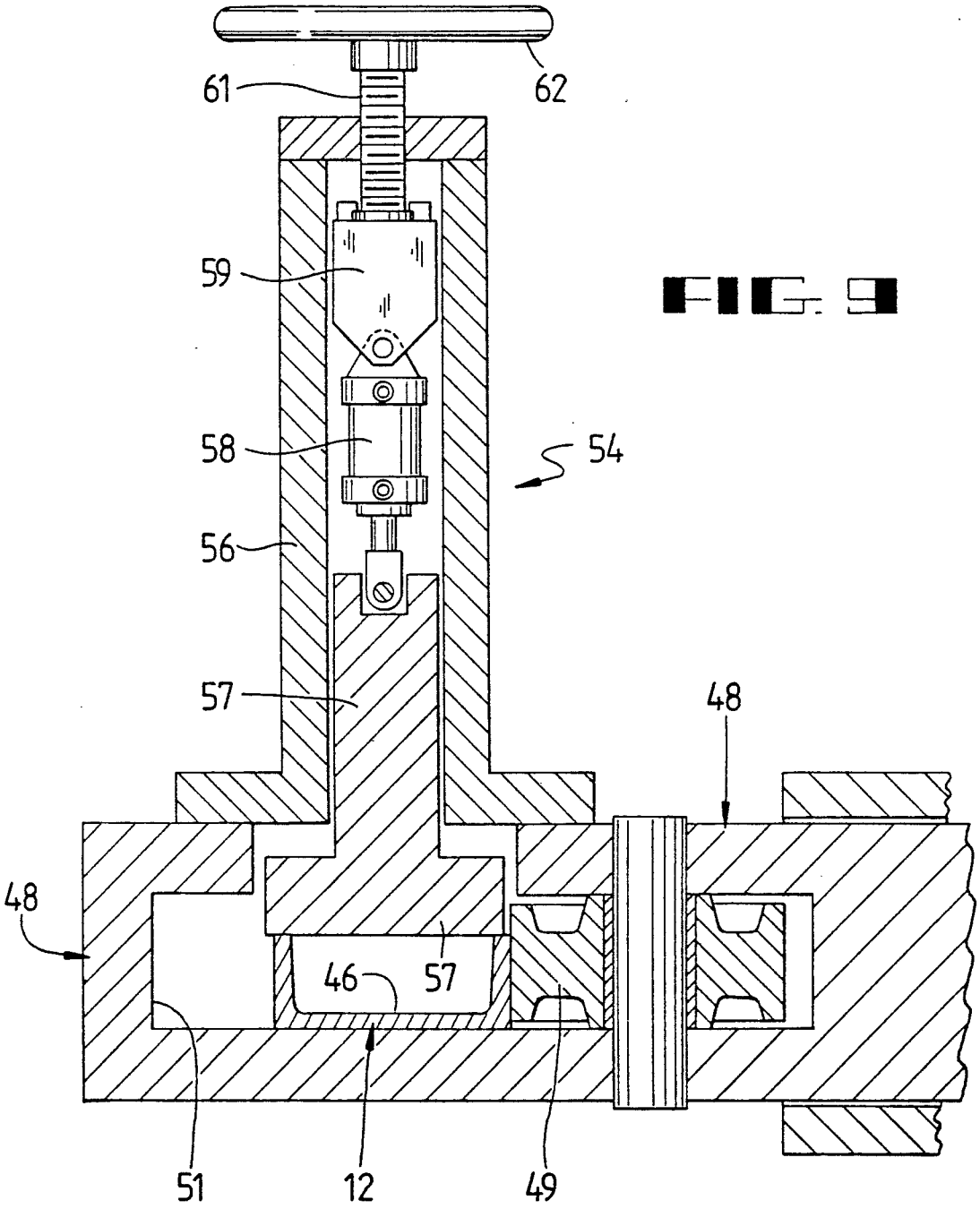
FIG. 9 is a sectional view taken along line 9—9 of FIG. 1.

As shown in FIG. 6, the elongated member 12 is held in a selected plane by the press plate 33, a first clamp 52 mounted to the frame 14 proximal the brace roller 41 and above the press plate 33, a second clamp 53 mounted to the frame 14 proximal the flexible form 11 and above the press plate 33, and a third clamp 54 mounted to the bending ram 44 above the channel 51. As shown in FIGS. 7, 8 and 9, the clamps 52, 53 and 54 each include a vertical tubular guide 56, a clamp ram 57 slidably received within the tubular guide 56 and extending therefrom toward the elongated member 12 and a fluid operated clamp actuator 58 connected to the clamp ram 57 and received within the tubular guide 56. A clamp crosshead 59 is connected to the clamp actuator 58 and is slidingly received within the tubular guide 56. A threaded shaft 61 is rotatably connected to the clamp crosshead 59 and threadably connected to the tubular guide 56 in coaxial extension therefrom. A hand wheel 62 is connected to the threaded shaft 61 for rotating the same to selectively position the crosshead 59, the clamp actuator 58 and the clamp ram 57 within the tubular guide 56.

In operation the elongated member 12 is urged longitudinally along the press plate 33 in intermittent feed strokes using apparatus and methods common in the industry. The elongated member 12 extends between the form 11 on one side and the brace roller 41 and the bending ram 44 on the opposite side. Prior to conveying the elongated member 12 the clamp rams 57 are positioned, by rotation of the hand wheel 62, in near contacting relation with the elongated member 12; and one or more mandrels 63 are received within the elongated member 12 adjacent the form 11 and subjacent the second clamp 53. Subsequent to each feed stroke, the clamp rams 57 are telescoped from the tubular guides 56 by the clamp actuators 58. The bending ram 44 then urges a second end portion 64 of the elongated member 12 transversely, thereby urging the elongated member 12 against the form 11 to bend the elongated member thereabout.

Figure 10:
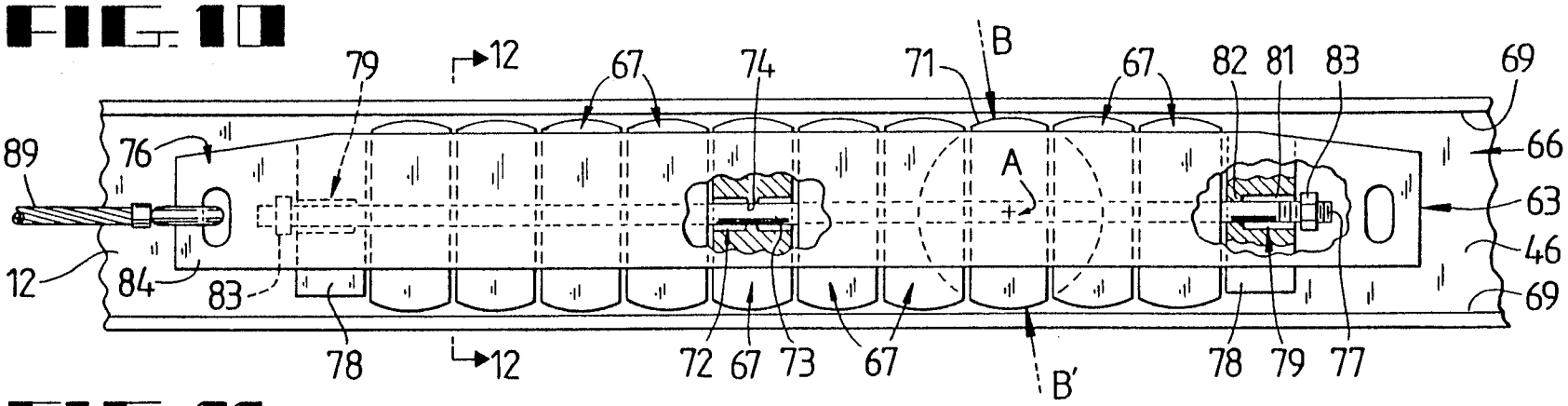
FIG. 10 is a plan view of a first embodiment of a mandrel seated within a channel member.
Figure 11:
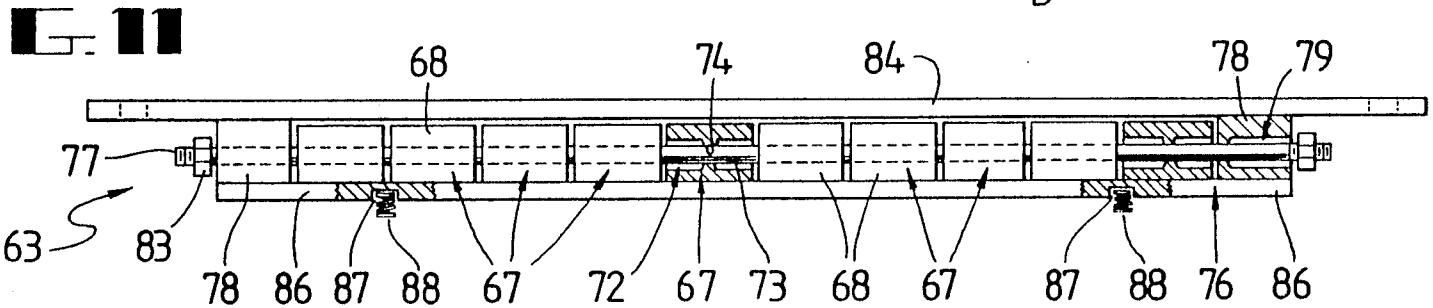
FIG. 11 is a partially sectioned side elevational view of a first embodiment of a mandrel.

As shown in FIGS. 2, 3 and 6, the flexible mandrel 63 is slidably received axially within the elongated member 12 and positioned opposite the form 11. FIGS. 2, 3, 7 and 10–12 show a first embodiment of the flexible mandrel 63 which is specifically designed for use with a channel member 66. The first embodiment of the mandrel 63 includes a plurality of parallel plate members 67 having exposed faces 68. The plate members 67 are dimensioned such that the faces 68 are slightly separated from opposing surfaces 69 of the channel member 66. The exposed faces 68 are rounded to present an arcuate surface 71 for engaging the opposing surfaces 69 during bending. As shown in FIG. 10, the curvature of the arcuate surfaces 71 is such that any two contact points between the opposing and arcuate surfaces 69 and 71, taken at the same height, are end points of a diametric chord extending through the vertical mid-axis A of the plate member 67.

Figure 12:
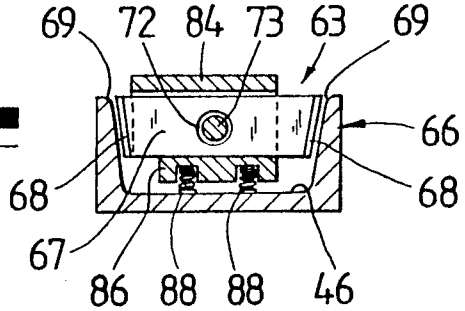
FIG. 12 is a sectional view taken along line 12—12 of FIG. 10.
Figure 14:
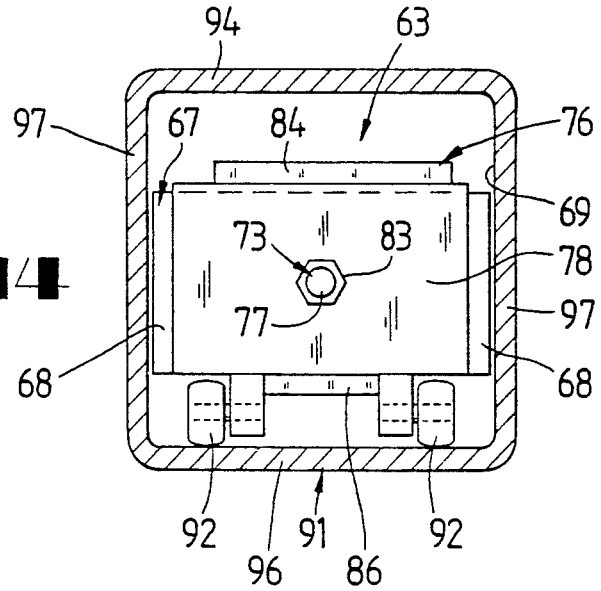
FIG. 14 is a sectional view of a second embodiment of a mandrel seated within a rectangular tube member.

During the bending process, the bending forces exerted on the channel member 66 will urge the opposing surfaces 69 inward into abutment with the arcuate surfaces 71. Forces, indicated by arrows B and B', exerted by the opposing surfaces 69 will always be directed radially against the arcuate surface 71 and through the vertical axis A. In as much as the opposing surface 69 abuts the plate member 67 on a constant diametric chord, the separation between the opposing surfaces 69 is held constant during the bending process. As shown in FIGS. 7 and 12, the plate members 67 are trapezoidal to accommodate the downwardly converging opposing surfaces 69 of the channel member 66. Each plate member 67 has an aperture 72 through which a rod 73 extends in sliding, substantially perpendicular relation to the plate member 67. Each aperture 72 has a reduced diametric annulus 74 formed at the mid-point of the plate member 67 to allow the rod 73 to flex without engaging the plate member 67 throughout the thickness thereof; thus preventing unnecessary stress being exerted on either the plate member 67 or the rod 73.

A carriage 76 is connected to the ends 77 of the rod 73 for holding the plate members 67 thereon. As shown in FIGS. 2, 3, 10 and 11, the carriage 76 includes a pair of panels 78 each mounted proximal an end 77 of the rod 73 in normal relation thereto. Each panel 78 has an aperture 79 extending normally therethrough having an outer portion 81 and an internally reduced inner portion 82 connected to the outer portion 81. The rod 73 is secured therein by a securing member 83, such as an internally threaded nut operatively connected to each end 77 of the rod 73. An upper carrier plate 84 is connected to the panels 78 and extends proximal the plate members 67 in perpendicular relation thereto. A lower carrier plate 86 is connected to the panels 78 in spaced relation to the upper carrier plate 84. The securing members 83 are spaced on the ends 77 of rod 73 to permit sliding motion thereof within the apertures 72 and 79; thus allowing the plate members 67 and rod 73 to adjust laterally during the bending process while still maintaining the plate members 67 in substantially parallel planar alignment. As best shown in FIG. 10, the carrier plates 84 and 86 are connected to the panels 78 in laterally eccentric relation to plate members 67 to accommodate the bend of elongated member 12; thus, the plate members 67 extend further beyond the carrier plates 84 and 86 on one side of the mandrel 63 than the other. The mandrel 63 is positioned with the longer side of the plates 67 adjacent the form 11 during bending. The lower carrier plate 86 has a plurality of notches 87 formed in the underside thereof in which a plurality of springs 88 are partially received. The springs 88 protrude from the notches 87 to support the carriage 76 on the web 46 which forms the bottom of the channel member 66 in which the mandrel 63 is received. A linkage 89 such as a flexible rod or chain of predetermined length is connected to carriage 76 and to the frame 14 to continuously position the mandrel 63 adjacent the form 11.

Figure 15:
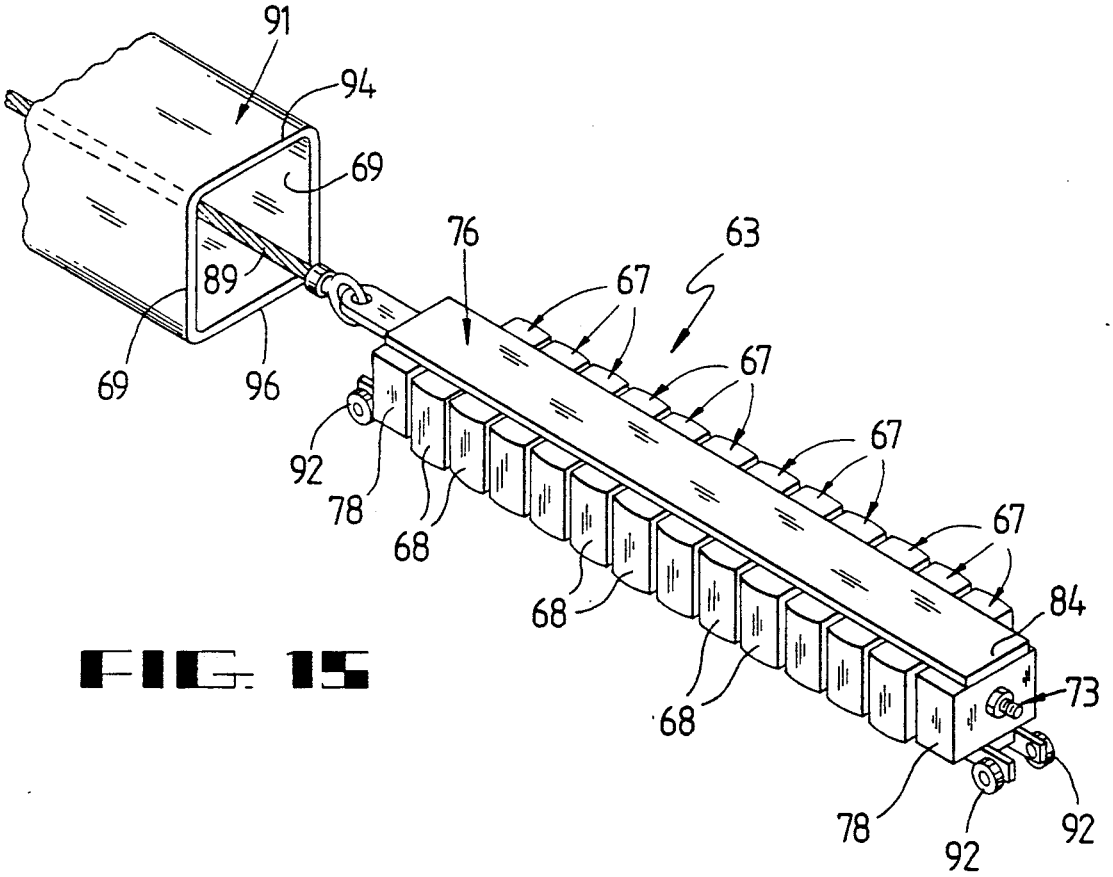
FIG. 15 is a perspective view of the second embodiment of a mandrel and a rectangular tube member.
Figure 16:
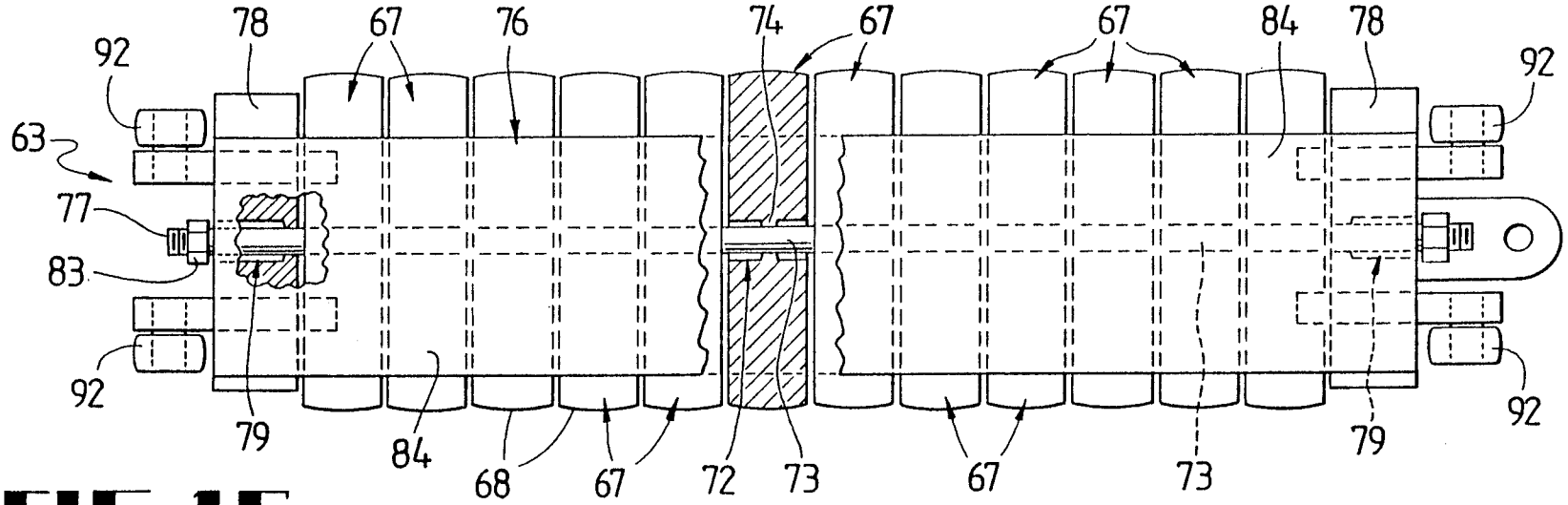
FIG. 16 is a plan view of a second embodiment of a mandrel.
Figure 17:
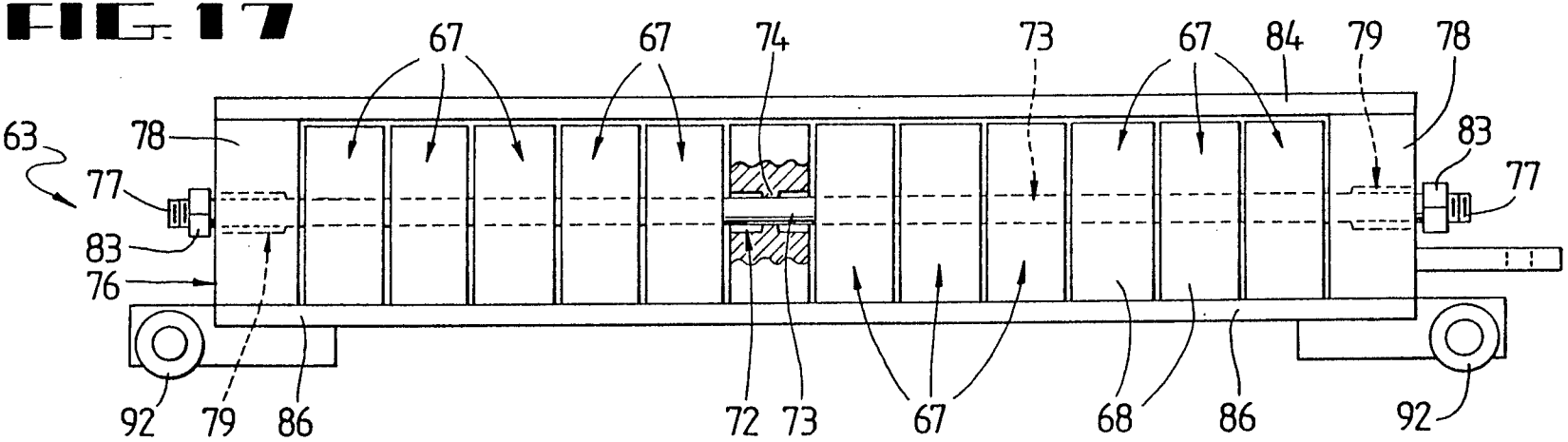
FIG. 17 is a side elevational view of a second embodiment of a mandrel.

FIGS. 13–17 show a second embodiment of the mandrel 63 which is slidably received within a rectangular tubular member 91. The second embodiment has predominantly the same components as the first embodiment exclusive of the notches 87 and springs 88. Additionally, a plurality of wheels 92 are rotatably connected to panels 78 and the lower carrier plate 86 to support the carriage 76 within the tubular member 91. The plate members 67 of the second embodiment are rectangular to accommodate the vertical opposing surfaces 69 of the rectangular tube member 91; however, the lateral faces remain rounded as shown in FIGS. 15 and 16 and as previously set forth in the description of the first embodiment. Note that the second embodiment of the mandrel 63 is designed to maintain the spacing of the center line of the opposing surfaces 69 thereby preventing the buckling thereof.

When a channel member 66 is to be bent and the first embodiment of the flexible mandrel 63 is seated within the channel member 66, the first and third clamps 52 and 54 are extended to contact the channel member 66 while the second clamp 53 contacts the upper carrier plate 84 which extends above the channel member 66. The extension of the second clamp 53 will press the lower carrier plate 86 in sliding abutment with the horizontal web 46, thereby urging the springs 88 completely within the notches 87 and positioning the plate members 67 within the opposing surfaces 69 of the channel member 66. As the channel member 66 is urged against the form 11, the flexible form 11 distributes the bending force exerted thereby across a predetermined length of the channel member 66.

During bending, flexible mandrel 63 prevents the channel member 66 from buckling. The plate members 67 shift in relation to one another to accommodate the bend of the opposing surfaces 69 while preventing the deformation thereof. During bending of the channel member 66, the opposing surfaces 69 move inward to abut the plate members 67. Upon completion of the bend, the resiliency of the channel member 66 will force the opposing surfaces 69 outward to their approximate original cross-sectional configuration. The space between the exposed faces 68 and the opposing surfaces 69 varies depending on the size and configuration of the channel member 66 but is selected to prevent the inward movement of the opposing surfaces 69 past the elastic limitation of the chosen material from which the channel member 66 is constructed. The clearance space between the plate members 67 and the opposing surfaces 69 facilitates unhindered sliding motion of the mandrel 63 as the channel member 66 moves past the form 11.

When a rectangular tubular member 91 is to be bent and the second embodiment of the mandrel 63 is received therein, the first, second and third clamps are actuated to contact an upper side 94 of the rectangular tubular member 91 thereby urging a lower side 96 of the tubular member 91 in sliding abutment with the press plate 33. Normally, when such rectangular tubing is bent in a plane, the sides of the tubing parallel to the plane (i.e. the upper and lower sides 94 and 96) tend to buckle outwardly while the sides extending transversely to the plane, shown as vertical sides 97, tend to buckle inwardly. The second clamp 53 of the present invention prevents the upper side 94 from buckling while the press plate 33 prevents the lower side 96 from buckling. The plate members 67 of the second embodiment of the mandrel 63 are spaced similarly to those in the first embodiment and prevent the vertical sides 97 from moving inwardly past the elastic limitation of the selected material from which they are constructed. From the foregoing, it should be clear that the present apparatus represents a substantial improvement over prior bending apparatus.

While I have shown my invention in one form, it will be obvious to those skilled in the art that it is not so limited but is susceptible of various changes and modifications without departing from the spirit thereof.

What I claim is:

1. An apparatus for use in bending an elongated metal member having at least one transverse web without substantially altering the cross-sectional configuration thereof, comprising a form about which an elongated member is bent in the plane of the transverse web to a selected curvature, wherein said form includes:

(a) at least one primary seat supported for rotational movement about a selected axis; and (b) a plurality of secondary seats each carried by said primary seat for rotational movement about axes parallel said selected axis, wherein each said secondary seat extends a predetermined distance from said primary seat and has a substantially planar outer face against which said elongated member is urged to facilitate the bending thereof.

2. Apparatus as described in claim 1 wherein said primary seat comprises a plurality of recesses wherein said secondary seats are received in sliding rotational abutment with said primary seat.

3. Apparatus as described in claim 1 comprising means placed intermediate said secondary seat and said elongated member to distribute bending forces over an area opposite and adjacent said form.

4. Apparatus as described in claim 1 wherein said form further comprises at least one flexible plate positioned proximal said outer faces in substantially parallel planar relation thereto wherein said elongated member, when bent about said form, contacts said flexible plates and presses said flexible plates either in planar abutment with adjacent flexible plates or said outer faces.

5. Apparatus as described in claim 1 wherein said form comprising a flexible mandrel slidably received within said elongated member in a selected region thereof to be bent.

6. Apparatus as described in claim 5 wherein said mandrel comprises:

(a) a plurality of parallel rigid plate members having exposed faces adjacent opposing defining surfaces of said elongated member; and (b) means connected to said plurality of plate members for maintaining each said plate member of said plurality of plate members in sliding parallel planar abutment to adjacent plate members of said plurality.

7. Apparatus as described in claim 6 wherein said maintaining means comprises:

(a) at least one flexible rod slidably received within a plurality of aligned apertures formed in said plurality of plate members wherein said rod extends through each plate member of said plurality of apertures in substantially normal relation thereto; and (b) a carriage connected to the ends of said rod for holding said plurality of plate members thereon.

8. Apparatus as described in claim 6 wherein said exposed faces of said plate members are rounded.

9. Apparatus as described in claim 8 wherein said exposed faces are defined by a common radius of curvature measured from the center of said plate member at a selected height thereon.

10. Apparatus as described in claim 7 wherein each said aperture has a reduced diameter annulus formed therein at the center of said rigid plate.

11. Apparatus as described in claim 7 wherein said carriage comprises:

(a) a pair of end panels receiving opposing ends of said rod therethrough; and (b) securing members detachably connected to said rod to prevent the retraction of said rod from said end panels.

12. Apparatus as described in claim 11 wherein said carriage further comprises:

(a) an upper carrier plate integrally connected to said panels; and (b) a lower carrier plate integrally connected to said panels in spaced relation to said upper carrier plate, wherein said plate members are positioned intermediate said upper and lower carrier plates and said panels are spaced a predetermined distance apart.

13. Apparatus as described in claim 12 wherein the longitudinal length of said rod measured from one said securing member to the other is greater than said predetermined distance between said panels.

14. Apparatus as described in claim 12 wherein said lower carrier plate has a plurality of notches formed on a lower surface thereof in which a plurality of springs are partially received, wherein said springs protrude from said notches to support said carriage within said elongated member.

15. Apparatus as described in claim 12 wherein said carriage further comprises a plurality of wheels rotably connected thereto for supporting said carriage within said elongated member.

16. Apparatus as described in claim 5 further comprising means connected to said mandrel for continuously positioning said mandrel in said region to be bent.

17. Apparatus as described in claim 16 wherein said positioning means comprises a linkage connected intermediate said mandrel and a frame supporting said elongated member.

18. An apparatus as described in claim 5 wherein said form comprises:

(a) at least one primary seat supported for rotational movement about a selected axis; and (b) a plurality of secondary seats each carried by said primary seat for rotational movement about axis parallel said selected axis, wherein each said secondary seat extends a predetermined distance from said primary seat and has a substantially planar outer face against which said elongated member is urged to facilitate the bending thereof.

19. Apparatus as described in claim 18 comprising means placed intermediate said secondary seat and said elongated member to distribute bending forces over an area opposite and adjacent said form.

20. Apparatus as described in claim 19 wherein said form further comprises at least one flexible plate positioned proximal said outer faces in substantially parallel planar relation thereto wherein said elongated member when bent about said flexible form, contacts said flexible plates and presses said flexible plates either in planar abutment with adjacent flexible plates or said outer faces.

21. An apparatus for use in bending an elongated metal member having at least one transverse web without substantially altering the cross-sectional configuration thereof, comprising:

(a) a form about which an elongated member is bent in the plane of the transverse web to a selected curvature;

(b) a frame connected to and supporting said elongated member;

(c) means connected to said frame for restricting lateral movement of said elongated member, wherein said restricting means includes a brace roller rotably mounted to said frame and positioned in tangential abutment with said elongated member; and (d) means connected to said frame for urging one end of said elongated member transversely of the web thereof.

22. Apparatus as defined in claim 22 wherein said urging means comprises:

(a) a ram slide slidably connected to said frame for reciprocal movement parallel said web;

(b) means connected intermediate said frame and said ram slide for intermittently forcing said ram slide in said second direction; and (c) means movably connected to said ram slide opposite said forcing means for contacting said elongated member.

23. Apparatus as defined in claim 22 wherein said ram slide comprises a channel through which said elongated member extends, wherein said contacting means is rotably mounted within said channel and abuts said elongated member when said elongated member is urged laterally by said urging means.

24. Apparatus as defined in claim 21 further comprising means connected to said frame and said ram slide for holding said elongated member in a selected plane.

25. Apparatus as defined in claim 24 wherein said holding means comprises:

(a) a press plate connected to said frame for supporting said elongated member;

(b) a first clamp mounted to said frame proximal said brace roller and adjacent said press plate;

(c) a second clamp mounted to said frame proximal said form and adjacent said press plate; and (d) a third clamp mounted to said ram slide proximal said channel wherein said first, second and third clamp selectively urge said elongated member against said press plate.

26. An apparatus as defined in claim 25 wherein said first and second clamps each comprise:

(a) a tubular guide connected to said frame normal to said press plate and said ram slide;

(b) a clamp ram slidably received within said tubular guide and extending therefrom toward said press plate;

(c) a fluid operated clamp actuator connected to said clamp ram and received within said tubular guide; and (d) means connected to said clamp actuator and said tubular guide for selectively positioning said clamp actuator and said clamp ram within said tubular guide.

27. Apparatus as defined in claim 26 wherein said means for selectively positioning comprises:

(a) a clamp crosshead connected to said clamp actuator and received within said tubular guide in loose sliding abutment therewith;

(b) a threaded shaft rotably connected to said clamp crosshead and threadably connected to said tubular guide; and (c) a handle connected to said threaded shaft for rotating the same.

28. An apparatus as described in claim 27 wherein said third clamp comprises:

(a) a tubular guide connected to said bending ram proximal said channel in normal relation to said press plate and said ram slide;

(b) a clamp ram slidably received within said tubular guide and extending therefrom through said slide;

(c) a fluid operated clamp actuator connected to said clamp ram and received within said tubular guide; and (d) means connected to said clamp actuator and said tubular guide for selectively positioning said clamp actuator and said clamp ram within said tubular guide.

29. An apparatus for use in bending an elongated member having a transverse web without substantially altering the cross-sectional configuration thereof, comprising an articulated form that facilitates the uniform distribution of force across a selected length of said elongated member being bent transversely to said web, wherein said articulated form includes:

(a) at least one primary seat mounted for rotational movement adjacent said selected length, wherein said primary seat has a plurality of recesses formed therein; and (b) a plurality of secondary seats received within said recesses for rotational movement therein and extending outwardly therefrom to define a plurality of substantially planar outer faces against which said elongated member is urged to facilitate the bending thereof.

30. Apparatus as described in claim 29 wherein said form further comprises at least one flexible plate positioned intermediate said plurality of outer faces and said elongated member.

31. Apparatus as described in claim 30 further comprising a flexible mandrel slidably received within said elongated member proximal said form.

* * * * *